US008926167B2

(12) United States Patent
Beugin et al.

(10) Patent No.: US 8,926,167 B2
(45) Date of Patent: Jan. 6, 2015

(54) ESCAPEMENT SYSTEM FOR A SPRUNG BALANCE RESONATOR

(71) Applicant: Montres Breguet SA, L'Abbaye (CH)

(72) Inventors: Stephane Beugin, Les Rousses (FR); Davide Sarchi, Renens (CH); Nakis Karapatis, Premier (CH); Fabio Sciascia, Valeyres-sous-Ursins (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/220,223

(22) Filed: Mar. 20, 2014

(65) Prior Publication Data

US 2014/0307530 A1 Oct. 16, 2014

(30) Foreign Application Priority Data

Apr. 12, 2013 (EP) ..... 13163484

(51) Int. Cl.
*G04B 15/00* (2006.01)
*G04B 15/14* (2006.01)

(52) U.S. Cl.
CPC ..... *G04B 15/14* (2013.01); *G04B 15/00* (2013.01)
USPC ..... 368/127; 368/124

(58) Field of Classification Search
USPC ..... 368/124, 125, 128–133
See application file for complete search history.

(56) References Cited

U.S. PATENT DOCUMENTS 1,232,285 A * 7/1917 Greeley ..... 368/132
1,860,260 A * 5/1932 Marti ..... 368/151
1,895,666 A * 1/1933 Junghans ..... 368/124

FOREIGN PATENT DOCUMENTS

EP 2 498 141 A2 9/2012
FR 690 365 9/1930
FR 726 956 6/1932

OTHER PUBLICATIONS

European Search Report issued Oct. 28, 2013 in EP Application 13163484, filed on Apr. 12, 2013 ( with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The invention relates to a timepiece including a resonator cooperating with an escapement system. According to the invention, the escapement system includes a moving escape wheel arranged coaxially to the balance and driven by the gear train of the timepiece, a first fixed wheel having a first toothing and a second fixed wheel having a second toothing, the first and second fixed wheels being arranged coaxially to the moving escape wheel and a device for securing the outer end of the balance spring including a part hinged relative to the moving escape wheel and arranged to ensure a radial movement of the outer end between the first and second toothings to maintain the resonator and to transmit the motion thereof to the timepiece gear train.

31 Claims, 9 Drawing Sheets

ESCAPEMENT SYSTEM FOR A SPRUNG BALANCE RESONATOR

This application claims priority from European Patent application No. 13163484.2 filed Apr. 12, 2013, the entire disclosure of which is hereby incorporated herein by reference.

FIELD OF THE INVENTION

The invention relates to an escapement system for a sprung balance resonator and, more specifically, for a high amplitude resonator of this type.

BACKGROUND OF THE INVENTION

The purpose of a timepiece escapement system is to maintain and to count the oscillations of the balance wheel of a sprung balance resonator. To achieve this, the system receives the energy provided by a barrel and at the end of the chain by a seconds wheel in order to periodically allow a fragment of this drive energy to escape in order to give to the resonator energy lost through passive resistance (for example friction), the resonator including an inertia fly-wheel called a balance on the staff of which there is fixed a spiral spring called a balance spring.

The mechanical energy $E_m$ of this type of sprung balance resonator is given by the following relation:

$$E_m = \frac{1}{2}kA^2 = \frac{1}{2}J(2\pi f)^2A^2 \quad (1)$$

where:

J is the inertia of the balance;

f is the frequency of the balance;

A is the oscillation amplitude of the balance.

Watchmaking technology tends to increase the energy of the sprung balance resonator in order to improve its precision and shock resistance, owing to the increase in the inertia J of the balance and/or the increase in the oscillation frequency f of the balance. However the increase in these parameters causes great difficulties.

Indeed, the increase in the inertia J of the balance tends to increase its weight which causes unwanted dry friction and/or lowers its aerodynamics. Further, the increase in oscillation frequency f requires a considerable increase in virtual power which is liable to decrease the power reserve of the timepiece. It is also clear that the increase in oscillation frequency f necessarily means that the escapement functions become shorter and shorter which represents a real kinematic and tribological challenge.

SUMMARY OF THE INVENTION

It is an object of the present invention to overcome all of part of the aforecited drawbacks by proposing an alternative escapement system for a sprung balance resonator which allows the mechanical energy $E_m$ of said resonator to be increased, while avoiding the aforementioned pitfalls.

Therefore, according a first variant, the invention relates to a timepiece including a resonator, formed by a balance associated with a balance spring and cooperating with an escapement system, characterized in that the escapement system includes a moving escape wheel arranged coaxially to the balance and driven by the gear train of the timepiece, a first fixed wheel having a first toothing and a second fixed wheel having a second toothing, the first fixed wheel being arranged inside the second fixed wheel in the same plane and leaving a space forming a closed channel, said first and second fixed wheels being arranged coaxially to the moving escape wheel, and a device for securing the outer end of the balance spring including a part hinged relative to the moving escape wheel and arranged to ensure, according to the state of winding of the balance spring, a radial movement of said outer end between said first and second toothings to maintain the resonator and to transmit its motion to the timepiece gear train.

According to a second variant, the invention relates to a timepiece including a resonator formed by a balance associated with a balance spring and cooperating with an escapement system, characterized in that the escapement system includes a moving escape wheel arranged coaxially to the balance and driven by the timepiece gear train, a first fixed wheel having a first toothing and a second fixed wheel which, mounted above the first wheel, has a second toothing, the first toothing having a smaller inner diameter than that of the second toothing, said first and second fixed wheels being arranged coaxially to the moving escape wheel and a device for securing the outer end of the balance spring including a part hinged relative to the moving escape wheel and arranged to ensure, according to the state of winding of the balance spring, a radial movement of said outer end between said first and second toothings to maintain the resonator and to transmit its motion to the timepiece gear train.

According to a third variant, the invention relates to a timepiece including a resonator formed by a balance associated with a balance spring and cooperating with an escapement system, characterized in that the escapement system includes a moving escape wheel arranged coaxially to the balance and driven by the timepiece gear train, a first series of teeth and a second series of teeth, the series of teeth are distributed circularly and coaxially to the moving escape wheel, the first series of teeth being distributed circularly in the same plane on a smaller radius than that of the second series of teeth, and a device for securing the outer end of the balance spring including a part hinged relative to the moving escape wheel and arranged to ensure, according to the state of winding of the balance spring, a radial movement of said outer end between said first and second series of teeth to maintain the resonator and to transmit its motion to the timepiece gear train.

In these three variants, the part hinged relative to the moving escape wheel preferably includes at least one impulse pin for cooperating with the first and second toothings or series of teeth. However, more particularly in the second variant, the hinged part of the securing device includes a first arm at the end of which there is fixed a first impulse pin arranged to cooperate with the first toothing of the first fixed wheel, and a second arm at the end of which there is fixed a second impulse pin arranged to cooperate with the second toothing of the second fixed wheel, each arm being capable of being offset in height.

It is thus clear that instead of increasing the inertia J of the balance and/or oscillation frequency f, the escapement system proposes, advantageously according to the invention, to increase the oscillation amplitude A of the balance in order to increase the mechanical energy $E_m$ of the resonator. Advantageously according to the invention, from relation (1), it is also clear that increasing the oscillation amplitude A of the balance will have a greater effect since amplitude A is squared.

It will be noted here that, for resonators with a low quality factor, including sprung balance resonators whose Q factor is less than 1000, the disruption to operation caused by the escapement system increases with an increase in the ratio between the maintenance angle and oscillation amplitude. It is thus clear, advantageously according to the invention, that the increase in amplitude A of the balance considerably reduces said disruptions.

In known pallets or detent type escapement systems, this increase in amplitude is not structurally possible, since amplitude is generally limited to 320 degrees. Further, the escapement system acts on the impulse pin integrated in the balance each time that the balance passes through its position of equilibrium or dead-point.

Advantageously according to the invention, where the desired amplitude exceeds the known limit of 320 degrees to achieve at least one complete revolution of the balance and is able to extend over several complete revolutions (this increase not being intrinsically limited), the present invention makes it possible to maintain the balance spring directly and not the balance as in conventional escapements. Maintaining the balance spring directly means that the escapement system can be started by the motion of the balance spring, for example by the radial movement of its outer end.

In accordance with other common advantageous features of the invention:

- the outer end of the balance spring is integral with a free end of said part hinged relative to the moving escape wheel or is integral with said at least one impulse pin;
- the moving escape wheel is moveably mounted relative to a fixed part of the timepiece using a ball bearing;
- the fixed part of the timepiece is the main plate;
- the balance and the inner end of the balance spring are fixed to an arbour pivoting between a bridge and the geometric centre of the first fixed wheel;
- the moving escape wheel is formed of a frame containing the resonator, the balance and the inner end of the balance spring being fixed to an arbour pivoting between the walls of the frame, and the frame pivoting between a bridge and the geometric centre of the first fixed wheel;
- the first and second fixed wheels are made in one piece;
- said at least one impulse pin is magnetised and the toothings or teeth are made of paramagnetic material having a magnetic permeability greater than 1.5, or said at least one impulse pin is made of paramagnetic material having a magnetic permeability greater than 1.5 and the toothings or teeth are magnetised to allow magnetic bonding between said toothings and said at least one impulse pin.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
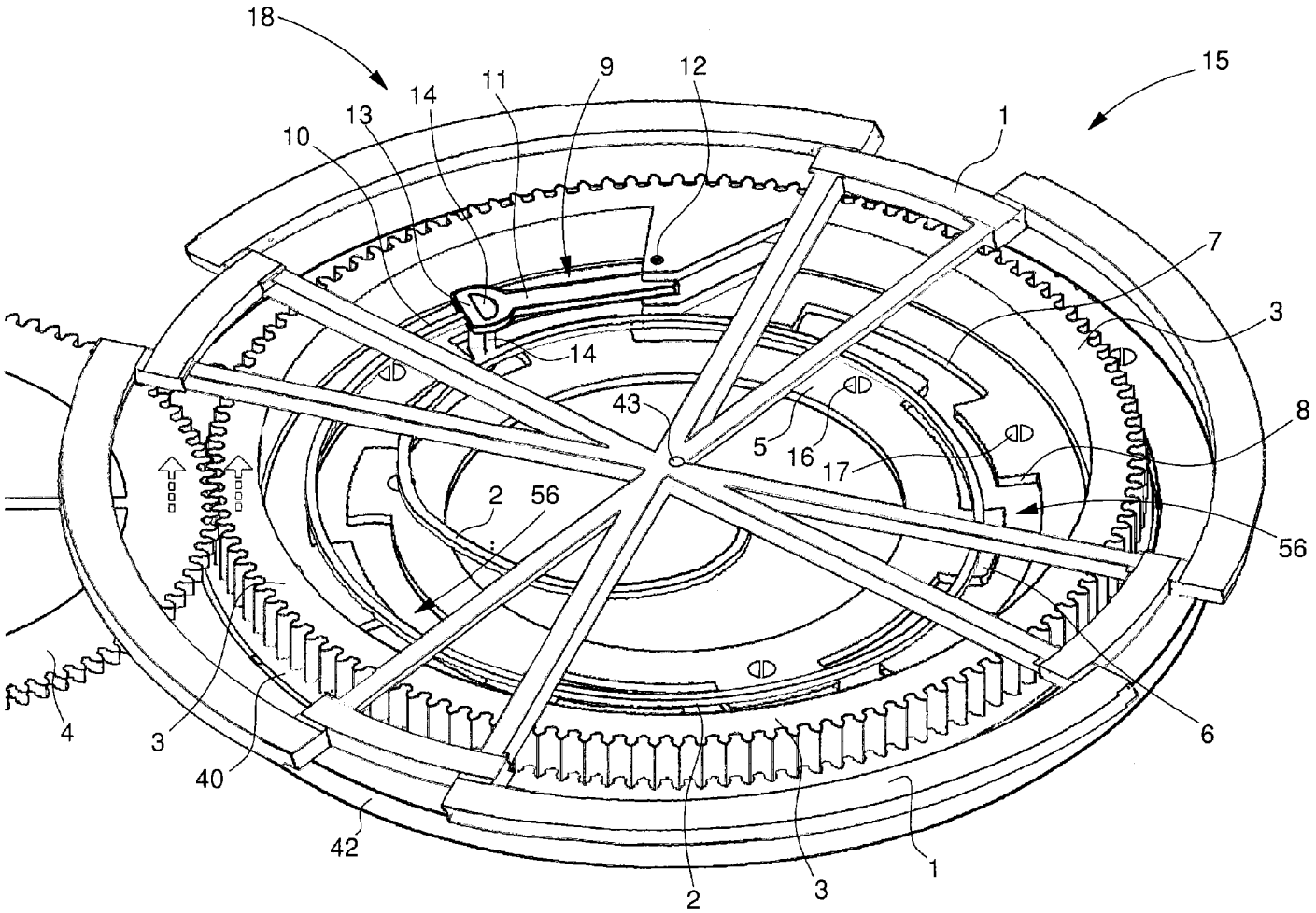
FIG. 1 is a perspective view of a first embodiment of the escapement system according to the invention.

A first embodiment of the present invention is illustrated in FIG. 1 which is a perspective view of an oscillator of the invention, i.e. an escapement system 18 coupled to a sprung balance resonator 15. Resonator 15 according to the invention includes a balance 1 associated with a balance spring 2.

Balance spring 2 is only represented by a limited number of coils for the clarity of the drawing and to avoid concealing the elements underneath said spring. However, balance spring 2 may, of course, include a larger number of coils without departing from the scope of the invention. The inner end 50 of balance spring 2 is fixed to an arbour 43, for example by means of an integral collet (shown more clearly in FIG. 9). The example illustrated in FIG. 1 shows that balance 1 is also fixed to arbour 43.

According to the invention, escapement system 18 includes a moving escape wheel 3 arranged coaxially to resonator 15. In the example illustrated in FIG. 1, moving escape wheel 3 is driven by a seconds wheel 4 belonging to the timepiece gear train which is meshed with a barrel supplying the drive force of the timepiece.

Escapement system 18 further includes a first fixed wheel 5 having an outer toothing 6 and a second fixed wheel 7 having an inner toothing 8. In the example illustrated in FIG. 1, the two fixed wheels 5, 7 of escapement system 18 are arranged coaxially to moving escape wheel 3 and fixed to a fixed point of the timepiece, such as for example the main plate, by means of screws 16 and 17. Further, it is seen that the first and second fixed wheels 5 and 7 are arranged in the same plane, first wheel 5 being placed inside second wheel 7 leaving a space, forming a substantially notched and symmetrical closed channel 56, in which an impulse pin 14 can move.

Advantageously according to the invention, moving escape wheel 3 is provided with a device 9 for securing the outer end 10 of balance spring 2 to wind said spring. Further, securing device 9 is arranged to ensure, according to the state of winding of balance spring 2, a radial movement of outer end 10, which is made to cooperate alternately with toothing 6 of one of first and second fixed wheels 5 and 7 and then toothing 8 of the other. It is to be understood that this radial movement allows escapement system 18 to ensure the maintenance of resonator 15 and the escapement of seconds wheel 4.

Figure 9:
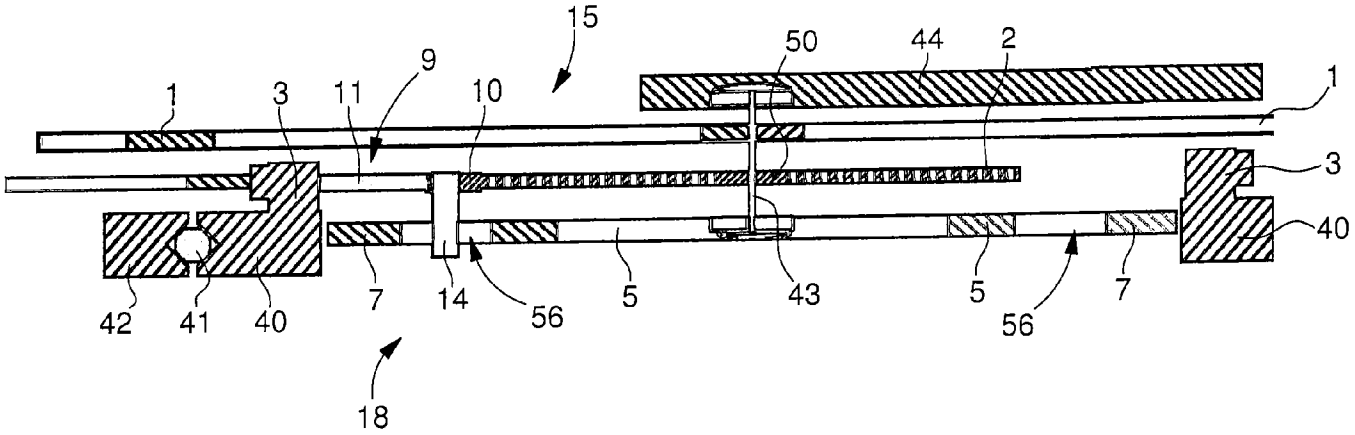
FIG. 9 is a cross-section of an escapement system according to FIG. 1.

FIG. 9 shows a main cross-section of FIG. 1. Moving escape wheel 3 is associated with an integral inner element 40 in the example of FIG. 9. The assembly of moving escape wheel 3 and inner element 40 is rendered rotatably mobile relative to a fixed point 42 of the timepiece, such as for example the main plate, preferably by using a ball bearing 41.

As shown more clearly in FIG. 9, balance 1 and inner end 50 of balance spring 2 are secured to arbour 43 pivoting between a bridge 44 and the geometric centre of the first fixed wheel 5, whether real or virtual as explained below.

Preferably, according to the first embodiment of the invention, securing device 9 includes a hinged bar 11 to ensure the radial movement of outer end 10 of balance spring 2. Bar 11 is mounted, on the one hand, on a pivoting balance spring stud 12 carried by moving escape wheel 3 and on the other hand, on outer end 10 of balance spring 2. In the example illustrated in FIG. 1, it can be seen that the outer end 10 of balance spring 2 is integral with impulse pin 14 which can move in the substantially notched and symmetrical closed channel 56 and is intended to be fitted to the free end 13 of bar 11. Preferably, impulse pin 14 is formed of the same material as balance spring 2 or is ruby-based.

When impulse pin 14 moves in channel 56, to facilitate its release from one 6 and then the other 8 of teeth 6, 8 fitted to fixed wheels 5 and 7, impulse pin 14 may be given the form of a cylindrical pin with a circular or elliptical section.

Figure 2:
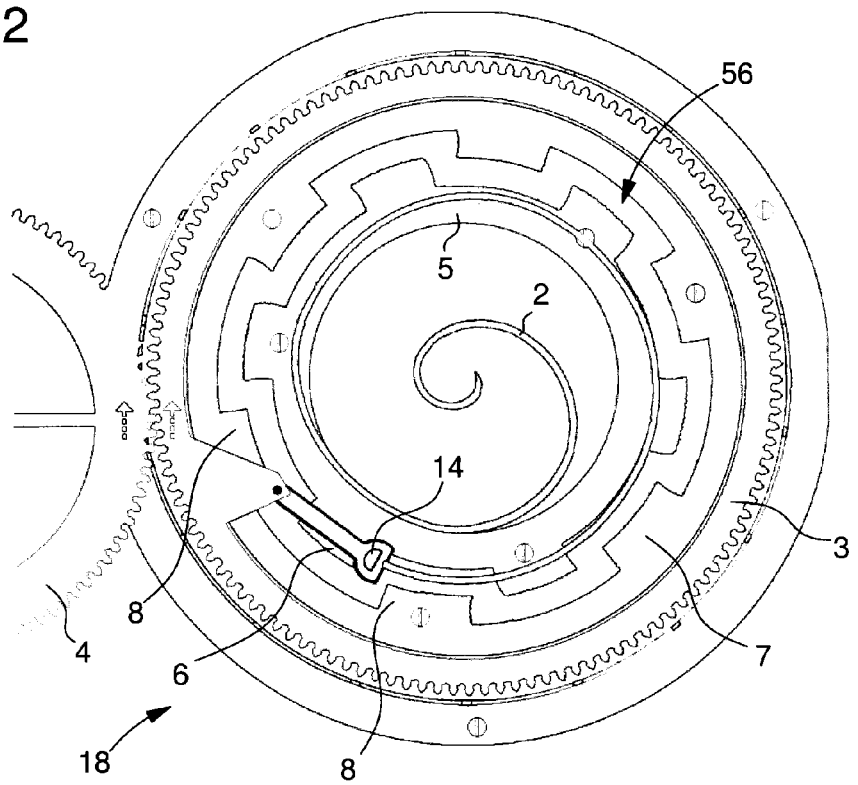
FIGS. 2 to 6 are plan views of the embodiment of FIG. 1 explaining the operation of an escapement system over two consecutive alternations of the sprung balance resonator according to the invention.
Figure 3:
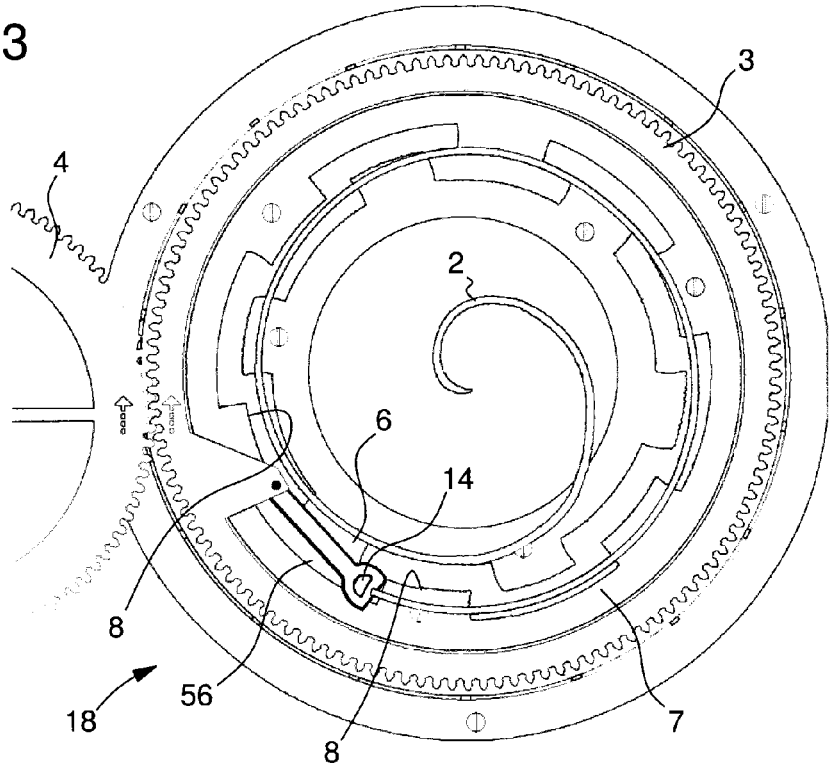
Figure 4:
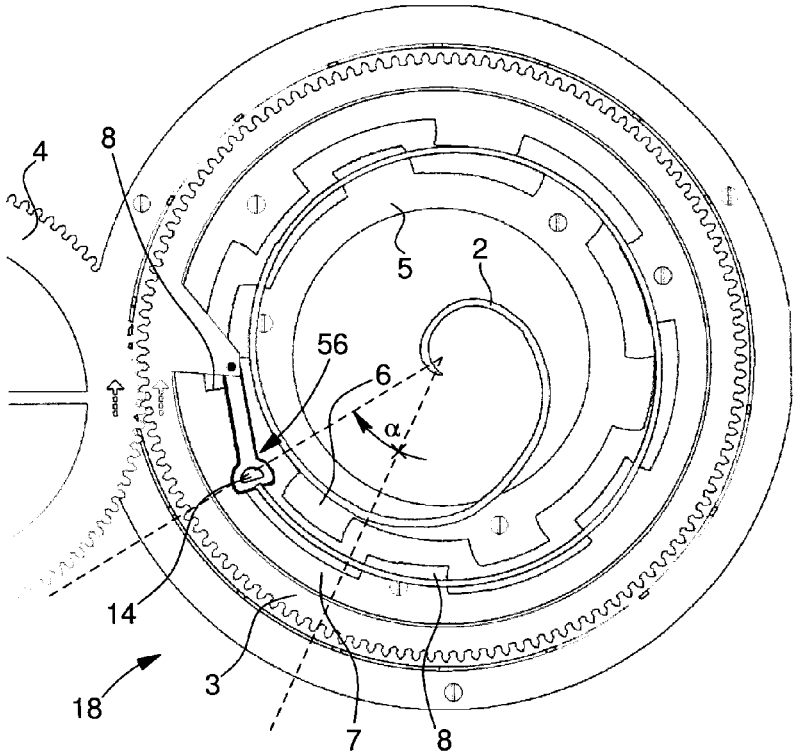
Figure 5:
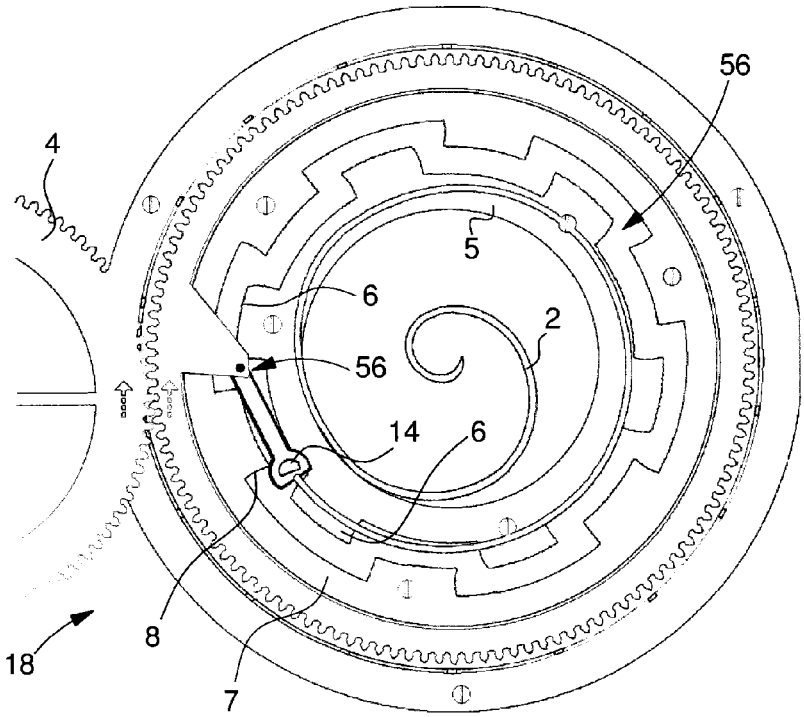
Figure 6:
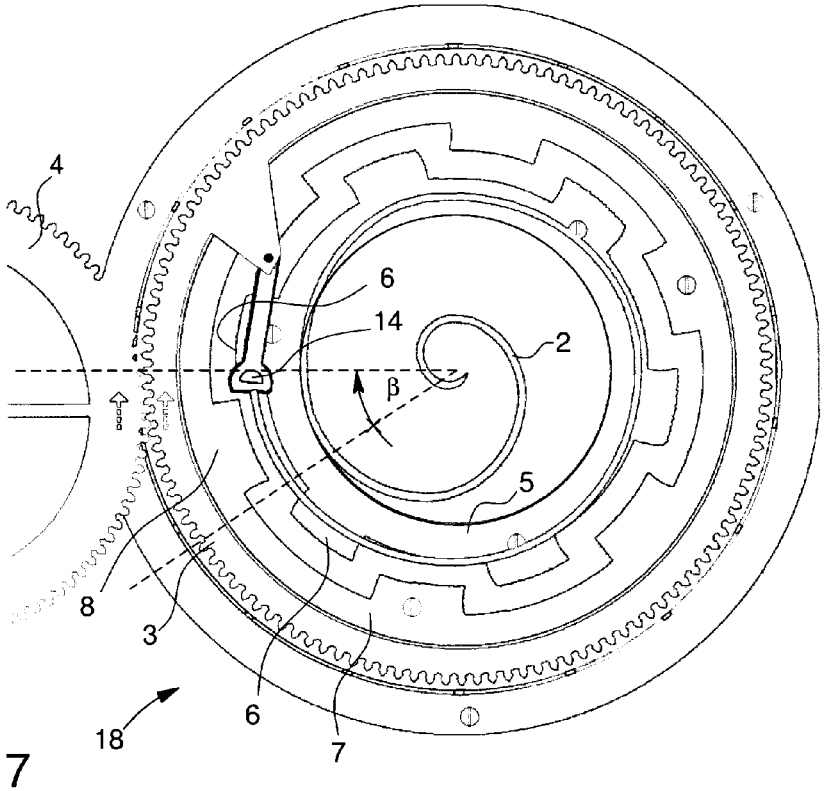
Figure 7:
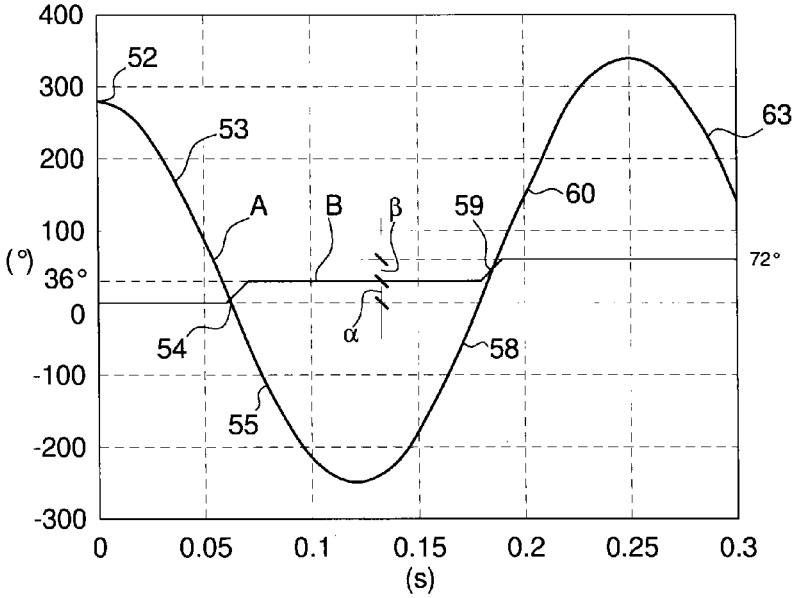
FIG. 7 is a graph accompanying the explanations relating to FIGS. 2 to 6.

The operation of escapement system 18 according to the invention will now be explained with reference to FIGS. 2 to 6 and to the graph in FIG. 7. These Figures describe the path of impulse pin 14 during two consecutive vibrations of balance spring 2 ensuring two consecutive escapements of seconds wheel 4. In FIG. 7, curve A shows the angle in degrees traveled by resonator 15 as a function of time in seconds, and curve B shows the angle in degrees traveled by moving escape wheel 3 as a function of time in seconds.

a) In FIG. 2, balance spring 2 is at maximum contraction (point 52 in FIG. 7) from which it enters a first expansion phase (area 53 in FIG. 7), which ends when the balance spring reaches its position of equilibrium or dead point 54 and during which impulse pin 14 is held locked against an outer tooth 6 of first fixed wheel 5.

b) In FIG. 3, from the position of equilibrium (point 54 in FIG. 7), balance spring 2 enters a second expansion phase (area 55 in FIG. 7), at the start of which impulse pin 14 is pushed radially, by the elastic deformation of the actual balance spring, out of outer tooth 6 of first fixed wheel 5 to be moved into channel 56 between two inner teeth 8 of second fixed wheel 7. It is thus clear that impulse pin 14 is freed by its radial movement relative to wheels 5, 7.

c) In FIG. 4, the released impulse pin 14 and, incidentally moving escape wheel 3, are driven by the seconds wheel 4 driven by the barrel of the timepiece. Consequently, moving escape wheel 3 moves through a first angle of impulsion a which causes impulse pin 14 to abut and lock against an inner tooth 8 of second fixed wheel 7. This movement causes balance spring 2 to travel through its second expansion phase 55 and then a first contraction phase (area 58 in FIG. 7) during which impulse pin 14 remains locked against the same inner tooth 8. The second expansion phase 55 and first contraction phase 58 define a first supplementary arc of balance 1.

d) In FIG. 5, the first contraction phase 58 ends when the balance spring reaches its position of equilibrium (point 59 in FIG. 7), after which balance spring 2 enters a second contraction phase (area 60 in FIG. 7), at the start of which impulse pin 14 is pushed radially out of inner tooth 8 of second fixed wheel 7 to be moved into channel 56 between two outer teeth 6 of first fixed wheel 5. It is thus clear that impulse pin 14 is again freed by its radial movement relative to wheels 5 and 7.

e) In FIG. 6, impulse pin 14 freed by its radial movement, and incidentally moving escape wheel 3, is driven by seconds wheel 4. Consequently, moving escape wheel 3 moves through a second impulse angle 3 which causes impulse pin 14 to abut and lock against a new outer tooth 6 of first fixed wheel 5. This movement causes balance spring 2 to travel through its second contraction phase 60 and then a new and repetitive first expansion phase (area 63 in FIG. 7 similar to area 53) during which impulse pin 14 remains locked against the new outer tooth 6. The second contraction phase 60 and new first expansion phase 63 define a second supplementary arc of balance 1.

In the first embodiment of FIGS. 1 to 6, FIG. 7 shows that the essential object of the present invention is achieved, namely the increase in oscillation amplitude A of the balance. Indeed, between position 52 and the change of direction point between areas 55 and 58, amplitude A of balance 1 is on the order of 550 degrees, which considerably exceeds the 320 degrees achieved by a Swiss pallets type escapement system. It is also clear that this increase in amplitude A is achieved by maintaining resonator 15, i.e. by supplying energy, directly via balance spring 2 by traction of the outer end 10 thereof and not par the actual balance 1 as in conventional Swiss pallets escapements. Advantageously according to the invention, it is thus no longer necessary to mount a roller on the balance staff.

Figure 8:
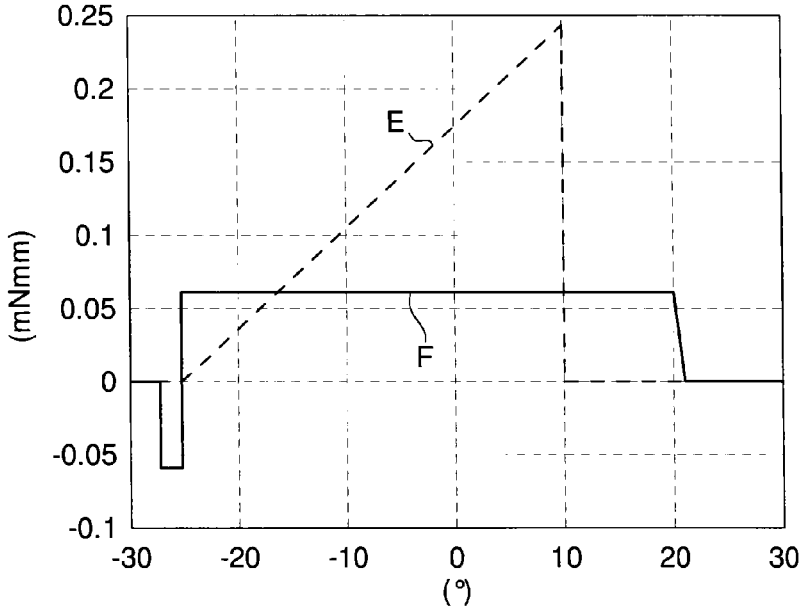
FIG. 8 is a graph comparing the torques exerted, on one hand, on the sprung balance resonator according to the invention and, on the other hand, on a sprung balance resonator cooperating with a Swiss pallets escapement system.

FIG. 8 is a graph comparing the torques transmitted in millinewtonmillimeters (mNmm), on the one hand, to resonator 15 of the present invention (line E) and, on the other hand, to an energetically equivalent sprung balance resonator fitted to a Swiss pallets type escapement system (line F). It is observed that the torque provided to resonator 15 of the invention in the angle during which it is applied is considerably greater (maximum on the order of 0.25 mNmm) than that provided to the sprung balance resonator of a conventional escapement system (maximum on the order of 0.06 mNmm), which explains the faster acceleration of balance 1 according to the invention, and, incidentally, allows the balance to achieve greater oscillation amplitude. It is also clear, advantageously according to the invention, that instantaneous velocity is greater when the rest point is crossed. For systems maintained by shocks, lower instantaneous velocity is a crippling intrinsic limitation.

FIG. 7 also shows that the angles $\alpha$ and $\beta$ respectively illustrated in FIGS. 4 and 6 are each substantially equal to 30 degrees and are covered ($\alpha+\beta$) in 0.25 seconds at a frequency substantially equal to 4 Hz. As a result, moving escape wheel 3 makes one revolution in substantially 1.5 second. It is thus clear that this same rotational motion affects resonator 15 which rotates in the manner of a tourbillon with a similar effect, i.e. this rotation enables the effects of gravity on resonator 15 to be averaged out and corrected.

Consequently, advantageously according to the invention, in addition to increasing mechanical energy $E_m$ as a result of the increase in oscillation amplitude A of balance 1, escapement system 18 also corrects the effects of gravity. It is also clear that escapement system 18 offers guaranteed self-starting of a high frequency movement even with high rigidity, increases stability and the quality factor without maintenance shocks, eliminates the risk of knocking and overbanking which are intrinsic to architecture, improves the efficiency of the escapement functions since losses are due solely to friction in the pivots and one wheel set and reduces the number of components to be oiled by omitting the pallets.

Figure 10:
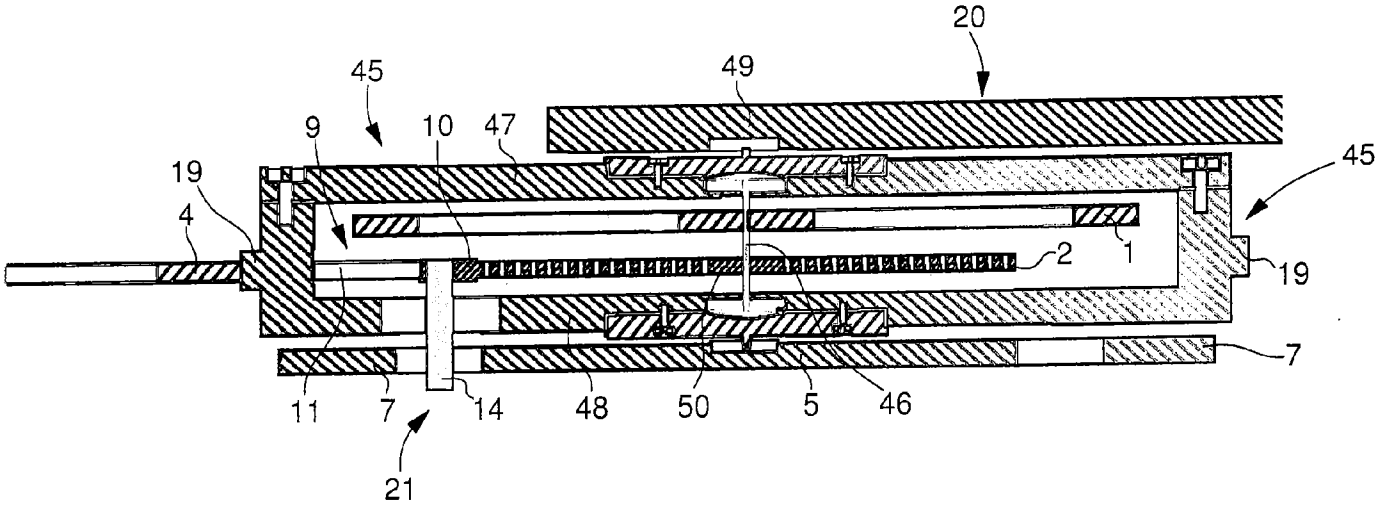
FIG. 10 is a cross-section of an escapement system according to a second embodiment.

Of course, the invention is not limited to the first embodiment but is capable of various variants and alterations while maintaining the effects and advantages cited above. In particular, a second embodiment of escapement system 21 according to the invention is illustrated in FIG. 10. In this second embodiment, moving escape wheel 3 of the first embodiment is replaced by a toothing 19 formed outside a frame 45. Frame 45 contains a resonator 20 which is of the same type as resonator 15 of the first embodiment. Thus, balance 1 and the inner end 50 of balance spring 2 are fixed to an arbour 46 pivoting between the walls 47 and 48 of frame 45. As seen in FIG. 10, frame 45 of escapement system 21 is pivotally mounted between a bridge 49 and the centre of the first fixed wheel 5.

Figure 11:
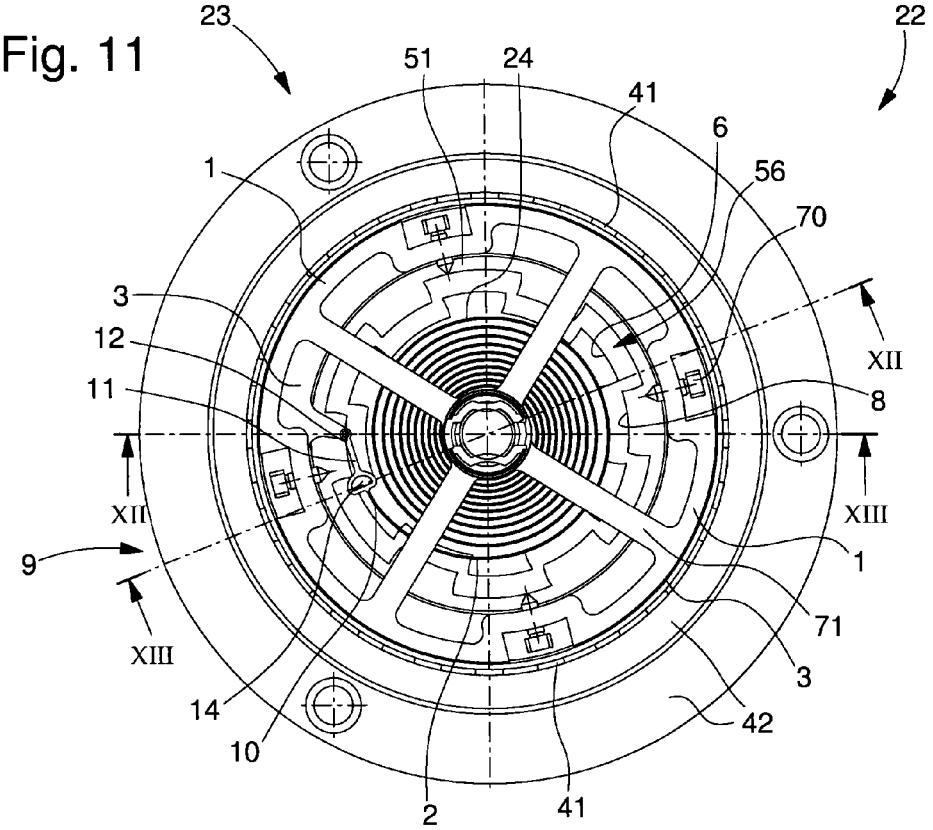
FIG. 11 is a plan view of an escapement system according to a third embodiment.
Figure 12:
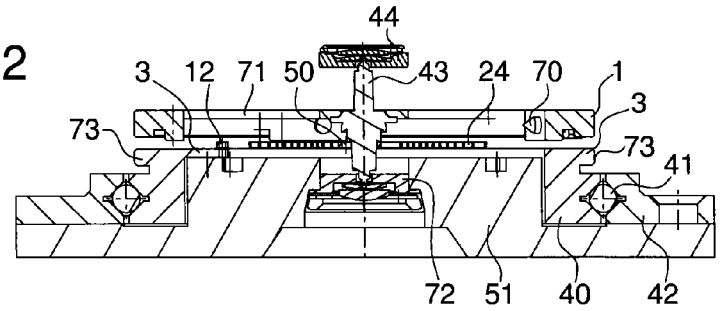
FIG. 12 is a cross-section along XII-XII of FIG. 11.
Figure 13:
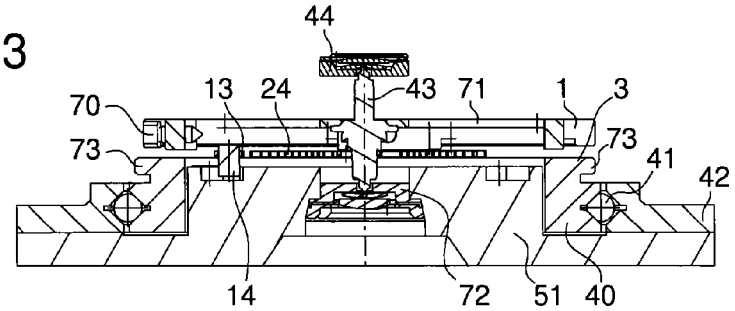
FIG. 13 is a cross-section along XIII-XIII of FIG. 11.

A third embodiment of escapement system 22 according to the invention is illustrated in FIGS. 11 to 13. Escapement system 22 differs from the two preceding embodiments in that the first and second fixed wheels 5 and 7 are made in a single piece.

In order to better explain this third embodiment, FIGS. 12 and 13 are respectively cross-sections taken along XII and XIII of FIG. 11. Resonator 23 of the third embodiment is of the same type as resonator 15, 20 of the first two embodiments. Balance 1 is thus seen again, fitted with poising screw 70 and connected to arbour 43 by means of four arms 71. Arbour 43 is pivotally mounted between bridge 44 and a bearing 72 integral with a unit 51 which incorporates, in a single piece, the outer teeth 6 and inner teeth 8 formed, in the first two embodiments, by fixed wheels 5 and 7.

Balance 1 is associated with balance spring 24 which includes more coils than balance spring 2 of the first embodiment and in which the end of the inner coil 50 is fixed to arbour 43 for example by means of a collet. The end of outer coil 10 is attached to impulse pin 14 fixed to the free end 13 of bar 11, said bar is hinged to balance spring stud 12 carried by moving escape wheel 3 as in the first embodiment. Moving escape wheel 3 is provided with a toothing 73 meshed with seconds wheel 4, also as in the first embodiment, and is associated with inner element 40 of a ball bearing 41 whose outer element 42 is integral with unit 51 fixed to a fixed point of the timepiece, such as for example its main plate.

Figure 14:
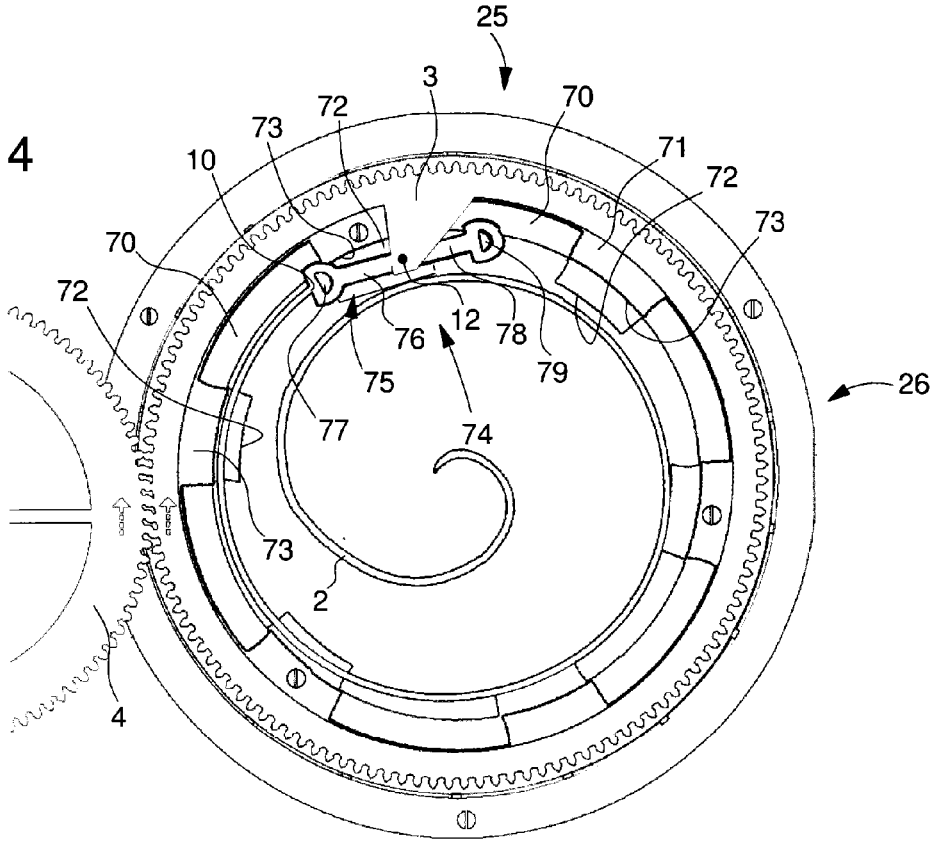
FIG. 14 is a plan view of an escapement system according to a fourth embodiment.

A fourth embodiment of the invention is illustrated in FIG. 14. Resonator 25 of the fourth embodiment is of the same type as resonator 15, 20, 23 of the first three embodiments. Contrary to what was shown in the three embodiments above, in which the first and second fixed wheels 5, 7 were located in the same plane, in the fourth embodiment, escapement system 25 includes first and second fixed wheels 70, 71 which are placed one on top of the other. The first and second fixed wheels 70, 71 respectively include first and second inner toothings 72, 73 which are superposed on each other.

It is also observed in FIG. 14 that the first teeth 72 have a smaller inner diameter than that of the second teeth 73. In the fourth embodiment, securing device 74 differs from device 9 of the first three embodiments. Thus, securing device 74 includes a lever 75 hinged on balance spring stud 12 carried by moving escape wheel 3. Lever 75 carries a first arm 76 at the end of which there are fixed the outer end 10 of balance spring 2 and a first impulse pin 77 arranged to cooperate with the first teeth 72 of first fixed wheel 70. Lever 75 also carries a second arm 78 at the end of which there is fixed a second impulse pin 79 arranged to cooperate with the second teeth 73 of second fixed wheel 71. Preferably, each impulse pin 77, 79 is formed of the same material as balance spring 2 or is ruby-based.

FIG. 14 shows a balance spring 2 of the type in the first embodiment in maximum expansion. The first impulse pin 77 is held locked against a first tooth 72 of the first fixed wheel 70. When balance spring 2 contracts, impulse pin 77 is moved radially inwards, causing lever 75 to pivot in an anti-clockwise direction and first impulse pin 77 to be released from a first tooth 72.

Second impulse pin 79 of lever 75 then enters the space separating two second teeth 73 which releases moving escape wheel 3 which then moves through a first impulse-angle by driving seconds wheel 4 until second impulse pin 79 abuts against a second tooth 73 of second fixed wheel 71.

A second impulse-angle is covered, as balance spring 2 changes to expansion, when the second impulse pin 79 is released from second tooth 73, lever 75 then rotating in the clockwise direction. The first impulse pin 77 then drops into the space separating two first teeth 72 and moving escape wheel 3 moves through a second impulse-angle by driving seconds wheel 4 until first impulse pin 77 abuts against a first tooth 72 of first fixed wheel 70. It will be noted in this fourth embodiment that, since fixed wheels 70 and 71 are arranged one on top of the other, second impulse pin 79 must have a shorter length relative to the length of first impulse pin 77.

Of course, the present invention is not limited to the illustrated example but is capable of various variants and alterations that will appear to those skilled in the art. In particular, the four embodiments presented above are capable of being combined in order to adapt to implementation constraints while maintaining the aforecited effects and advantages common to the four embodiments. By way of non-limiting example, the first 70 and second 71 fixed wheels of the fourth embodiment could be made in a single piece as proposed in the third embodiment.

It is also possible for the part hinged relative to moving escape wheel 3, 19, 45, i.e. by lever 75 or bar 11, to be replaced by a part of different shape, such as a substantially semi-cylindrical shaped part.

In an embodiment including several impulse pins 14, 77, 79, such as the fourth embodiment, it is possible to envisage offsetting in height the arms 76, 78 of part 75 hinged relative to moving escape wheel 3, 19, 45.

Further, the first and second toothings 6, 8, 72, 73 should be understood as stop members or contact surfaces for stopping and locking said at least one impulse pin 14, 77, 79. In this regard, the first and second toothings 6, 8, 72, 73 may be formed by pins, i.e. rods extending substantially parallel relative to said at least one impulse pin 14, 77, 79 in order to enter into contact with said at least one impulse pin 14, 77, 79 in accordance with the operation explained above. It is thus clear that the first and/or second toothings 6, 8, 72, 73 may in some way resemble a skeleton, i.e. not be entirely solid.

Figure 15:
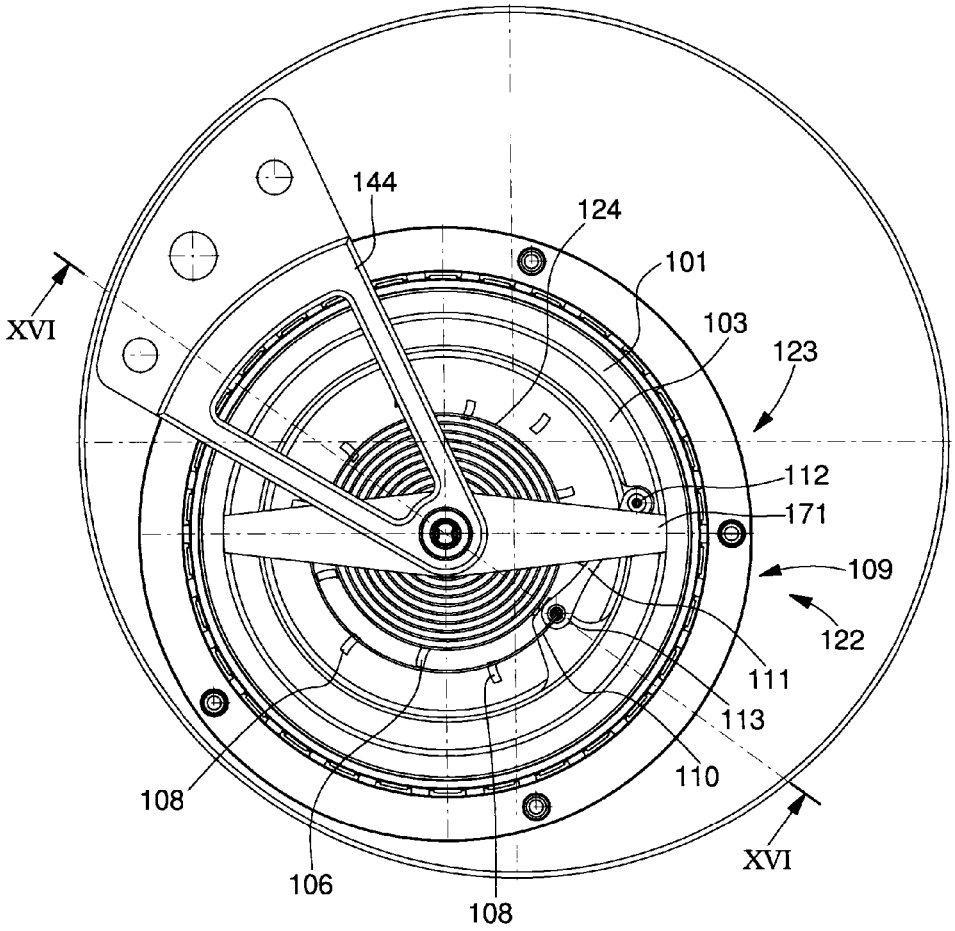
FIG. 15 is a plan view of an escapement system according to a fifth embodiment.
Figure 16:
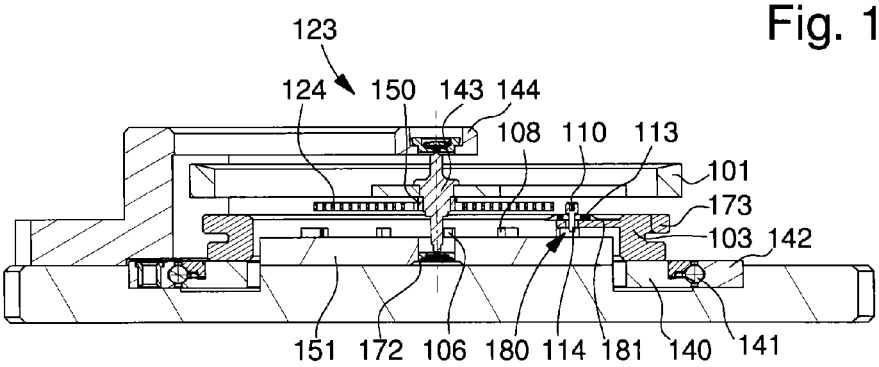
FIG. 16 is a cross-section along XVI-XVI of FIG. 15.
Figure 17:
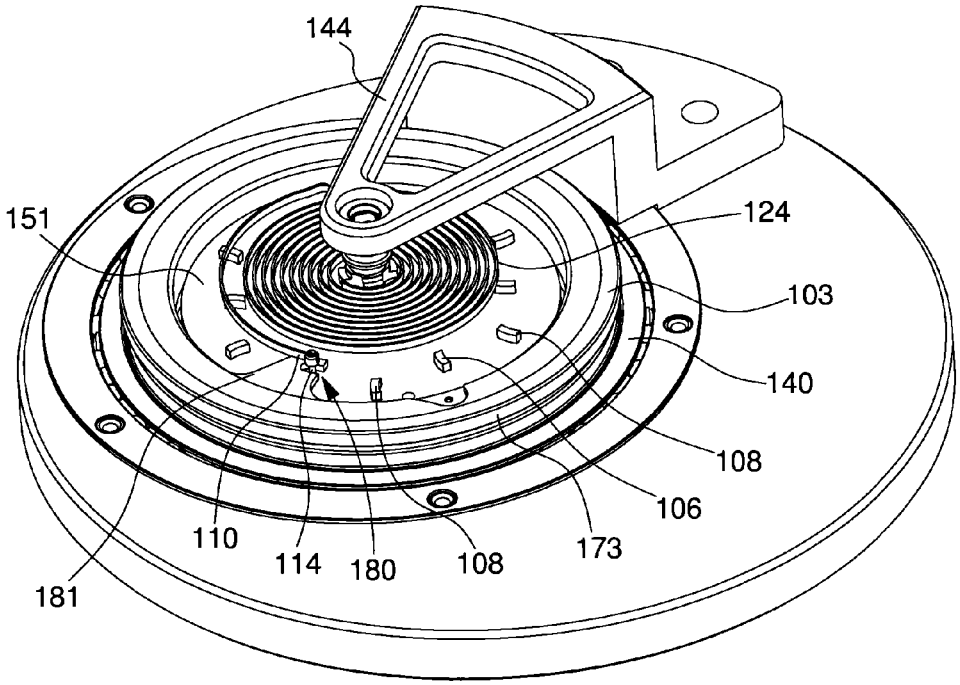
FIG. 17 is a partial perspective view of FIG. 15.

Thus, a fifth embodiment of escapement system 122 according to the invention is illustrated in FIGS. 15 to 17. Escapement system 122 differ from the preceding embodiments in that the space between the toothings is totally open and, more generally, the concept of first and second fixed wheels is not longer applicable since only the useful surfaces of the toothings are used.

In order to better explain this fifth embodiment, FIGS. 16 and 17 are respectively views taken along cross-section XVI-XVI and omitting part of the elements of FIG. 15. Resonator 123 of the fifth embodiment is similar to resonator 23 of the third embodiment. Balance 101 is therefore shown again connected to arbour 143 by means of two arms 171. Arbour 143 is pivotally mounted between bridge 144 and a bearing 172 integral with a unit 151 which incorporates outer teeth 106 and inner teeth 108 in a single piece.

Balance 101 is associated with balance spring 124 which includes more coils than balance spring 2 of the first embodiment and in which the end of the inner coil 150 is fixed to arbour 143 for example by means of a collet. The end of outer coil 110 is attached to impulse pin 114 fixed to the free end 113 of hinged part 111.

Part 111 is hinged to balance spring stud 112 carried by moving escape wheel 103 as in the other embodiments. Moving escape wheel 103 is provided with a toothing 173 meshed with seconds wheel 4, also as in the other embodiments, and is associated with inner element 140 of a ball bearing 141 whose outer element 142 is integral with unit 151 fixed to a fixed point of the timepiece, such as for example its main plate.

Thus as seen more clearly in FIG. 17, unit 151 includes a first series of teeth 106 and a second series of teeth 108. The series of teeth 106, 108 are distributed circularly and coaxially to the moving escape wheel 103. Further, the first series of teeth 106 is distributed circularly on a smaller radius than that of the second series of teeth 108 in the same plane. It is thus clear that the effects and advantages presented in the other four embodiments are maintained.

FIG. 17 also shows that the radial clearance of impulse pin 114 is limited by a groove 180 formed in a plate 181 extending cantilevered from the inner diameter of moving escape wheel 103 towards arbour 143. It is thus clear that amplitude is limited by the stop member between impulse pin 114 and the wall of plate 181 around groove 180.

Finally, in order to improve the locking of the above embodiments, magnetic bonding may also be provided between said toothings and said at least one impulse pin. Consequently, by way of example, said at least one impulse pin 14, 77, 79 may be magnetised and toothings 6, 8, 72, 73 or teeth 106, 108 may be made of paramagnetic material having a magnetic permeability greater than 1.5 or conversely, said at least one impulse pin 14, 77, 79 may be magnetised and toothings 6, 8, 72, 73 or teeth 106 108 may be made of paramagnetic material having a magnetic permeability greater than 1.5.

Of course, the embodiments and/or alternatives and/or variants cited above can be combined with each other depending on the required applications.

What is claimed is:

1. A timepiece including a resonator formed by a balance associated with a balance spring and cooperating with an escapement system, wherein the escapement system includes a moving escape wheel arranged coaxially to the balance and driven by the gear train of the timepiece, a first fixed wheel having a first toothing and a second fixed wheel having a second toothing, the first fixed wheel being arranged inside the second fixed wheel in the same plane and leaving a space forming a closed channel, the first and second fixed wheels being arranged coaxially to the moving escape wheel and a device for securing the outer end of the balance spring including a part hinged relative to the moving escape wheel and arranged to ensure, according to the state of winding of the balance spring, a radial movement of the outer end between the first and second toothings to maintain the resonator and to transmit the motion thereof to the timepiece gear train.

2. The timepiece according to claim 1, wherein the part hinged relative to the moving escape wheel includes at least one impulse pin for cooperating with the first and second toothings.

3. The timepiece according to claim 2, wherein the outer end of the balance spring is integral with the at least one impulse pin.

4. The timepiece according to claim 1, wherein the outer end of the balance spring is integral with a free end of the part hinged relative to the moving escape wheel.

5. The timepiece according to any of claim 1, wherein the first and second fixed wheels are made in a single piece.

6. The timepiece according to claim 1, wherein the moving escape wheel is formed of a frame containing the resonator, the balance and an inner end of the balance spring being secured to an arbour pivoting between the walls of the frame, the frame pivoting between a bridge and the geometric centre of the first fixed wheel.

7. The timepiece according to claim 1, wherein the moving escape wheel is moveably mounted relative to a fixed part of the timepiece by means of a ball bearing.

8. The timepiece according to claim 7, wherein the fixed part of the timepiece is the main plate.

9. The timepiece according to claim 1, wherein the balance and an inner end of the balance spring are fixed to an arbour pivoting between a bridge and the geometric centre of the first toothing.

10. The timepiece according to claim 2, wherein the at least one impulse pin is magnetised and the first and second toothings are made of paramagnetic material having a magnetic permeability greater than 1.5 in order to allow magnetic bonding between the toothings and the at least one impulse pin.

11. The timepiece according to claim 2, wherein the at least one impulse pin is made of paramagnetic material having a magnetic permeability greater than 1.5 and the first and second toothings are magnetised in order to allow magnetic bonding between the toothings and the at least one impulse pin.

12. A timepiece including a resonator formed by a balance associated with a balance spring and cooperating with an escapement system, wherein the escapement system includes a moving escape wheel arranged coaxially to the balance and driven by the timepiece gear train, a first fixed wheel having a first toothing and a second fixed wheel which, mounted above the first wheel, has a second toothing, the first toothing having a smaller inner diameter than that of the second toothing, the first and second fixed wheels being arranged coaxially to the moving escape wheel and a device for securing the outer end of the balance spring including a part hinged relative to the moving escape wheel and arranged to ensure, according to the state of winding of the balance spring, a radial movement of the outer end between the first and second toothings to maintain the resonator and to transmit the motion thereof to the timepiece gear train.

13. The timepiece according to claim 12, wherein the part hinged relative to the moving escape wheel includes at least one impulse pin for cooperating with the first and second toothings.

14. The timepiece according to claim 13, wherein the part of the securing device includes a first arm at the end of which there is secured a first impulse pin arranged to cooperate with the first toothing, and a second arm at the end of which there is secured a second impulse pin arranged to cooperate with the second toothing.

15. The timepiece according to claim 14, wherein the arms of the part are offset in height.

16. The timepiece according to claim 13, wherein the outer end of the balance spring is integral with a free end of the part hinged relative to the moving escape wheel.

17. The timepiece according to claim 13, wherein the outer end of the balance spring is integral with the at least one impulse pin.

18. The timepiece according to claim 12, wherein the first and second fixed wheels are made in a single piece.

19. The timepiece according to claim 12, wherein the moving escape wheel is formed of a frame containing the resonator, the balance and an inner end of the balance spring being secured to an arbour pivoting between the walls of the frame, the frame pivoting between a bridge and the geometric centre of the first fixed wheel.

20. The timepiece according to claim 12, wherein the balance and an inner end of the balance spring are fixed to an arbour pivoting between a bridge and the geometric centre of the first toothing.

21. The timepiece according to claim 13, wherein the at least one impulse pin is magnetised and the toothings or teeth are made of paramagnetic material having a magnetic permeability greater than 1.5 in order to allow magnetic bonding between the toothings and the at least one impulse pin.

22. The timepiece according to claim 13, wherein the at least one impulse pin is made of paramagnetic material having a magnetic permeability greater than 1.5 and the toothings or teeth are magnetised in order to allow magnetic bonding between the toothings and the at least one impulse pin.

23. A timepiece including a resonator formed by a balance associated with a balance spring and cooperating with an escapement system, wherein the escapement system includes a moving escape wheel arranged coaxially to the balance and driven by the timepiece gear train, a first series of teeth and a second series of teeth, the series of teeth are distributed circularly and coaxially to the moving escape wheel, the first series of teeth being distributed circularly on a smaller radius than that of the second series of teeth in the same plane, and a device for securing the outer end of the balance spring including a part hinged relative to the moving escape wheel and arranged to ensure, according to the state of winding of the balance spring, a radial movement of the outer end between the first and second series of teeth to maintain the resonator and to transmit the motion thereof to the timepiece gear train.

24. The timepiece according to claim 23, wherein the part hinged relative to the moving escape wheel includes at least one impulse pin for cooperating with the first and second series of teeth.

25. The timepiece according to claim 24, wherein the outer end of the balance spring is integral with the at least one impulse pin.

26. The timepiece according to claim 23, wherein the outer end of the balance spring is integral with a free end of the part hinged relative to the moving escape wheel.

27. The timepiece according to claim 23, wherein the moving escape wheel is moveably mounted relative to a fixed part of the timepiece by means of a ball bearing.

28. The timepiece according to claim 27, wherein the fixed part of the timepiece is the main plate.

29. The timepiece according to claim 23, wherein the balance and the inner end of the balance spring are fixed to an arbour pivoting between a bridge and the geometric centre of the first toothing.

30. The timepiece according to claim 24, wherein the at least one impulse pin is magnetised and the toothings or teeth are made of paramagnetic material having a magnetic permeability greater than 1.5 in order to allow magnetic bonding between the toothings and the at least one impulse pin.

31. The timepiece according to claim 24, wherein the at least one impulse pin is made of paramagnetic material having a magnetic permeability greater than 1.5 and the toothings or teeth are magnetised in order to allow magnetic bonding between the toothings and the at least one impulse pin.

* * * * *